United States Patent [19]

Duijve et al.

[11] Patent Number: 5,036,359

[45] Date of Patent: Jul. 30, 1991

[54] METHOD AND APPARATUS FOR SUPPLYING MATERIAL IN WEB FORM

[75] Inventors: Johan A. Duijve, Venlo; Gijsbertus Velraeds, Baarlo, both of Netherlands

[73] Assignee: Oce-Nederland B.V., Netherlands

[21] Appl. No.: 452,777

[22] Filed: Dec. 19, 1989

[30] Foreign Application Priority Data

Dec. 21, 1988 [NL] Netherlands ..... 8803121

[51] Int. Cl.[5] ..... G03G 15/00; B65H 19/00

[52] U.S. Cl. ..... 355/203; 355/310; 355/218; 358/304; 242/58

[58] Field of Search ..... 355/203, 218, 310, 311; 358/304; 340/675; 242/55.3, 58

[56] References Cited

U.S. PATENT DOCUMENTS 3,960,446 6/1976 Ogawa et al. ..... 355/310
4,891,662 1/1990 Noda ..... 355/29
4,969,016 11/1990 Kudoh ..... 355/310

FOREIGN PATENT DOCUMENTS 0088314 9/1983 European Pat. Off. .
58-117566 7/1983 Japan .

OTHER PUBLICATIONS

*Research Disclosure*, Mar. 1983, anon., "Means to Put Data, Related to Newly Loaded Copy Material, in a Copying Apparatus" 22721, p. 92.

*Primary Examiner*—Joan H. Pendegrass
*Attorney, Agent, or Firm*—Reed Smith Shaw & McClay

[57] ABSTRACT

Method and apparatus for determining the width and location of stored rolls of receiving material in web form, in which an unrolled initial strip of an inserted roll is fed past a measuring device disposed along a transport path provided jointly for receiving material fed from the rolls. The measuring device determines the width of a roll of web material when its initial strip is cut off by a cutting device, and the measured value together with a data item representative of the storage location of that roll being stored in a memory.

7 Claims, 2 Drawing Sheets

METHOD AND APPARATUS FOR SUPPLYING MATERIAL IN WEB FORM

FIELD OF THE INVENTION

This invention relates to a method and apparatus for automatically and selectively supplying material in web form in different widths from one of a plurality of storage locations in a common path, and, in particular, to method and apparatus for determining data representative of the width and location of the stored web material.

BACKGROUND OF THE INVENTION

Apparatus having a holder for a plurality of rolls of web material of different widths which can be inserted in the holder at different locations is known. In such a device there is a transport means for selectively supplying web material from the rolls into a common transport path. For example, Research Disclosure of March 1983, No. 22721, page 92, describes such an apparatus in which an inputting means is included for selecting rolls. This input means comprises several press buttons at each roll location, such that each press button represents a specific roll width dimension. After a roll has been placed in the holder, the press button corresponding to the width of the inserted roll is actuated manually in order to store a data item representing the width of the inserted roll and the location of that roll in the holder.

Since determination of the width of each roll placed in the holder and inputting the details has to be effected manually, this apparatus is sensitive to operating errors. Consequently there is a risk that on subsequent use of the apparatus the web material supplied may not have the required and expected width.

The object of this invention is to provide a method and apparatus without this disadvantage.

SUMMARY OF THE INVENTION

In the present invention it is possible to over come the disadvantage of the manual operation by providing automatic determination data item of web material. Generally the method comprises:

(a) feeding a part of the material web into the common path;

(b) measuring the width of that part and generating a signal which is representative of the storage location from which said part originates;

(c) determining a data item representative of the measured width and the signalled storage location;

(d) removing from the common path the supplied part of the material web.

In an apparatus according to the invention the data inputting means comprises a measuring device for measuring the width of the web material at a location situated in the first common transport path and providing a measurement signal representative of said measured width. A means for generating a second signal is provided which signal is representative of the location of the roll from which the associated web material originates. In response to the measurement signal and the second signal, the data inputting means automatically stores in memory a data item representative of the width of the roll of web material at that location in the holder.

Consequently, when web material is fed into the common path the correct width and location of the associated material are determined and on the subsequent required supply of web material, material of the required width is automatically fed from the location where material with that width is stored.

In one embodiment of the apparatus, a cutting device is disposed in the common transport path in front of the measuring station as considered in the feed direction. This cutting device is adapted to cut an initial strip from a roll of web material inserted in the holder. Means are provided, which on activation of the cutting device after insertion of said roll, activates the data inputting means. Consequently, the width measurement takes place automatically when a straight edge is formed at the front part of the web material by the cutting operation, so that when this holder is used in a copying machine based on the width of the incoming original sheet and the data stored in the memory, the correct roll of web material is selected automatically, and also the marginal width associated with that selected material.

In another embodiment, a deflecting element is disposed after the cutting device as considered in the feed direction. The deflecting element in its operative position deflects the web material originating from a roll into a second common transport path. In this embodiment, the measuring station is located in the second transport path. Consequently, web material originating from a roll is fed along the measuring station only when that roll is inserted. Thus, the measuring device remains without loading when web material is then fed from a selected roll and the measuring device, therefore, has the minimum sensitivity to soiling and/or wear and resulting malfunction which might occur due to material moving for long periods along the measuring device.

JP-A-58-117566 discloses a roll holder with a measuring means for the width of rolled-up material in web form, at the roll, and this necessitates duplication of the measuring device particularly in the case of a holder for a large number of rolls. The present invention over comes that problem by providing a single measuring means.

The invention also relates to a copying machine for copying an original on receiving material. Such a copying machine is preferably provided with adjustable margining means for limiting the area in which copying is carried out in a direction transversely of the feed direction of the receiving material. It is also preferably provided with a device in which receiving material in web form can be fed from a selected roll and separate sheets of receiving material can be fed via the second transport path into the copying machine in which the margin adjusting means is adjusted in accordance with the data item stored in the memory as representative of the width of the selected roll when the copying machine is set to copying on receiving material in web form. However, when the copying machine is set to copying on separate sheets of receiving material, the margining adjusting means automatically sets the margining means in accordance with the measured width of the sheet in response to an incoming sheet activate the measuring device.

Accordingly, the copying machine is suitable for measuring the width and corresponding adjustment of the marginal width, both in respect of receiving material in web form stored in the holder and in respect of separately supplied sheets of receiving material whose width dimension is not stored in the memory, e.g. sheets of special material which are fed manually into the copying machine without excessive load on the measuring device.

Other advantages of the invention will become apparent from a review of the detailed explanation of present by preferred embodiments of the invention taken with reference to the accompanying drawings.

PRESENTLY PREFERRED EMBODIMENT

Figure 1:
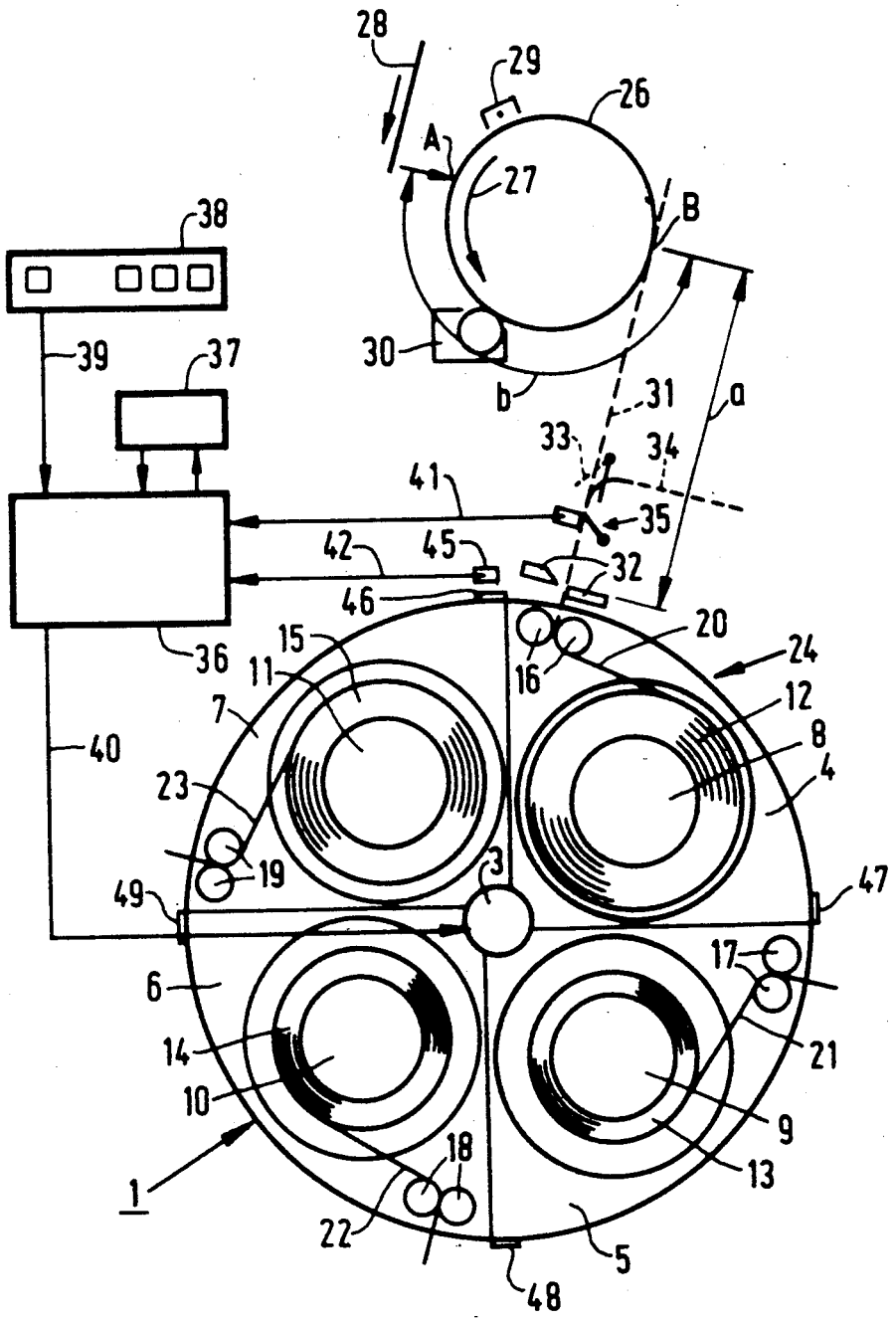
FIG. 1 is a diagramatic view of an electrophotographic copying machine using apparatus according to the invention.

The electrophotographic copying machine represented in FIG. 1 comprises a cylindrical holder 1 rotatable about central axis 3. Four compartments 4, 5, 6 and 7 are formed in holder 1. Each of these compartments contains an associated shaft 8, 9, 10 and 11 respectively, on which a roll of material in web form 12, 13, 14 and 15, respectively, is disposed. A pair of transport rollers 16, 17, 18 and 19, respectively, for unrolling web material from the associated roll and conveying said web material through associated transport path 20, 21, 22 and 23, respectively, extending into cylindrical surface 24 of holder 1. In this cylindrical surface 24 the distances between these paths 20, 21, 22 and 23 are equal. One embodiment of a roll holder of this type is described in European patent 0 088 314.

The electrophotographic copying machine also comprises a photoconductive drum 26 rotatable in the direction of arrow 27 and on which a charge image of an original 28 can be formed strip-wise at a location A by optical means not shown in detail. To this end, the photoconductive drum is pre-charged by means of a charging device 29. A developing system 30 is also disposed along the periphery of the photoconductive drum to develop the formed charge image with a developing powder.

Between holder 1 and peripheral part B of the photoconductive drum 26 there is a transport path 31. Holder 1 can occupy four different positions. In each of these positions one of the transport paths 20, 21, 22 and 23 adjoins the transport path 31. In each of these four positions only the pair of transport rollers in the transport path adjoining the transport path 31 is drivable; the other three transport roller pairs (pairs 17, 18 and 19 of FIG. 1) are locked against rotation. The web material fed into the transport path 31 by the driven transport roller pair (pair 16 in FIG. 1) takes over at location B the powder image formed on the photoconductive drum 26, the transferred powder image being fixed on the web material to form a copy of the original.

A cutting device 32 is disposed in transport path 31 near holder 1 to cut off a piece of unrolled web material. The length a of transport path 31 between the cutting location and the image transfer location B corresponds to the distance b between the image forming location A and the image transfer location B measured along the periphery of the photoconductive drum 26, so that when the speeds of the drum and the web material are equal the front edge of the image comes on the front edge of web material fed from the cutting location. When the rear edge of the original image passes the location A, the cutting device 32 is actuated to cut off a length of the web material corresponding to the length of the original 28.

A deflection element 33 is disposed in the transport path 31 after the cutting device 32 as considered in the direction of transport and can occupy two positions. In the first position shown in full lines, material fed into transport path 31 passes unobstructedly to image transfer location B. In the second position shown in broken-line, deflecting element 33 deflects from the transport path 31 material fed into that transport path 31 and leads it to discharge path 34. At that part of the transport path 31 which is situated between cutting device 32 and deflecting element 33 there is disposed a measuring device 35 for measuring the width of the web material situated in that part of transport path 31.

The copying machine also comprises a control system 36 for selectively feeding web material stored in holder 1 to photoconductive drum 26. The selected material has, for example, a width corresponding to the width of the original to be copied. Control system 36 is provided with a memory 37 in which it is possible to store information representing the width of the roll contained in the associated compartment. On control panel 38 it is possible to indicate the width of the material on which an image of an original is to be printed. A signal 39 corresponding to this width is fed to control system 36 which by comparing this width signal and the widths of the rolls as stored in memory 37 determines whether a roll having the stock width is or is not present and if so in which compartment the associated roll is situated. Control system 36 then generates a control signal 40 for automatically setting the holder 1 into the position in which the transport path (20, 21, 22 or 23) associated with the roll having the selected width adjoins common transport path 31.

The operation of the copying machine represented in FIG. 1 in an inputting mode for storing information in the memory representative of the width of a roll inserted in the holder in combination with the location of that roll in the holder is as follows: To insert a new roll into a specific compartment of the holder 1 the latter is set to a position in which the associated transport path 20, 21, 22 or 23 adjoins transport path 31. If the holder contains empty compartments, control system 36 can be so arranged that in the inputting mode an arbitrary empty compartment is automatically brought into the filling position. After the roll has been put in a compartment in the filling position (compartment 4 in FIG. 1), the initial strip of the associated web is pushed between the associated transport rollers, rollers 16 in this case. Deflecting element 33 is then actuated and the transport rollers 16 are driven for a fixed period sufficient to transport the initial strip of the roll—which is usually not straight and is damaged—to a position past the width sensor 35.

To conclude the insertion procedure, a signal is generated to activate the cutting device, such signal also activating measuring device 35. A measuring signal 41 which represents the measured width is fed to control system 36 together with a signal 42 representative of the compartment in which the associated roll has been inserted, for storage of the associated information in memory 37. Signal 42 is derived from the position of the holder 1 by means of a sensor 45 which is disposed at a fixed location and which reacts differently, in each of the positions of the holder 1, to a marking 46, 47 48 and 49, respectively, provided on the holder 1 at each compartment. The initial strip is discharged from the copying machine via path 34.

Instead of cutting off the initial strip and discharging the cutoff strip, the initial strip can be removed from the common transport path 31 after the width measurement, by withdrawing the unrolled web of material from the common transport path 31.

The copying machine can then be switched from the inputting mode to the copying mode. During copying control system 36 ensures that the holder 1 is always automatically put into a position in which copying material of the required width is supplied. This required width is set manually on the control panel 38 but may alternatively be set automatically, e.g. on account of measuring the width of an introduced original 28.

Figure 2:
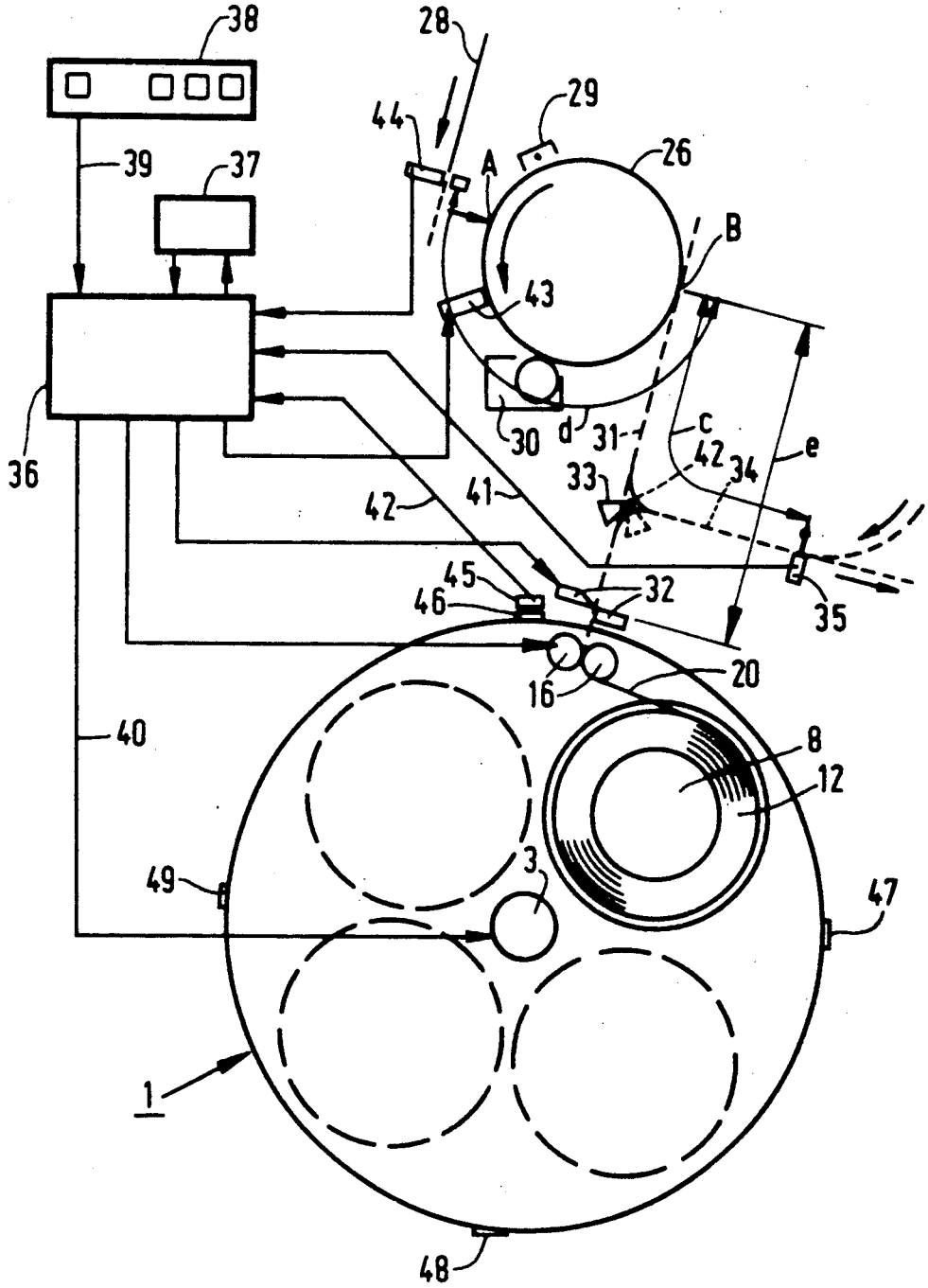
FIG. 2 is a diagrammatic view of an electrophotographic copying machine according to the invention.

The copying machine represented in FIG. 2 is provided with the rotatable cylindrical holder 1 according to FIG. 1 and it is, therefore, not shown in detail in FIG. 2. All those parts of the copying machine according to FIG. 2 which correspond to parts of the copying machine according to FIG. 1 have like references. The copying machine represented in FIG. 2 differs from the copying machine represented in FIG. 1 in the following respects:

Between charging device 29 and developing device 30 a margining device 43 is disposed near the photoconductive surface of drum 26. Margining device 43 is formed by an array of LED's which extends in the longitudinal direction of drum 26. During the passage of a charged part of the drum control system 36 switches off for a specific time a number of LED's determined by the measuring device 35 in order to limit the charged area on photoconductive drum 26. To enable the specific number of LED's to be switched off and then on again at the correct times the original transport path contains a detector 44 which, in response to the passing of the front and rear edges of an original 28, generates a signal in response to which control system 36 switches off the specific number of LED's or switches them on again at times at which the front and rear edges respectively of the charge image formed on photoconductive drum 26 pass the margining device 43.

Measuring device 35 is disposed in the discharge path 34. This discharge path also acts as a feed path for feeding separate sheets of receiving material to the image transfer location B if it is desired to transfer an image onto a special receiving material not present on rolls. To this end, a connecting path 42 is provided between path 34 and transport path 31. Since, in the copying machine represented in FIG. 2, measuring device 35 for measuring the width and position of the material fed through path 34 not only measures the initial strip of a roll of web material as described with reference to FIG. 1, but also acts to determine which of the LED's of the margining device 43 are to be switched off during the passage of a charge image, the distance c between measuring device 35 and image transfer location B measured along the transport path is determined as follows:

When holder 1 is used for feeding copying material, detector 44 delivers a signal on the passage of the leading edge of an original 28 to start the supply of web material from the cutting location and on the passage of the trailing edge delivers a signal for actuating the cutting device and stopping the supply. To cut off a sheet from the web in a length corresponding to the length of the original the distance e between the cutting location and the image transfer location B is at maximum equal to the distance d less the distance $r_1$ covered by the drum in the time elapsing between the delivery of a cutting signal by control device 36 and the actual cutting operation. The distance d is the sum of the path covered by original 28 as far as image forming location A and the path covered by the image formed on drum 26 as far as image transfer location B.

To switch off the LED's of margining device 43 as determined by measuring device 35, on the passage of the leading edge of the original 28 past detector 44 and then switch them on again on the passage of the trailing edge of said original 28 past detector 44, measuring device 35 must be disposed, as measured along the transport path, at a distance c from the image transfer location B, which distance c is at least equal to the length of the distance d between the detector 44 and the image transfer location B plus the distance $r_2$ covered by the photoconductor in the time elapsing between the measurement carried out by measuring device 35 and the switching off of the specific LED's of the margining device 43 in accordance with that measurement.

In the copying machine represented in FIG. 2, therefore, the measuring device 35 is situated at least at a distance c-e which corresponds to $r_1+r_2$, farther away from image transfer location B than the cutting device 32, both distances measured along the transport path. Given a drum speed of 10 m/min and time delays in adjusting margining device 43 to the measured material width and actuating the cutting device 32 equal to 0.3 second in each case, the distance $r_1+r_2$ is equal to about 100 mm. With selective supply of web material from holder 1 the margining device 43 is set to the width corresponding to the width stored in the memory for the web supplied.

In the case of continuous measurement of the width and the position of separate receiving sheets supplied along the measuring device 35, the marginal width can be instantaneously adjusted to the measured value in order thus to ensure, even in the case of a skew sheet, that the developed image formed on the photoconductive drum 26 coincides entirely with the sheet at the image transfer location B.

To achieve this even in the case of web material fed from holder 1, in another embodiment of the copying machine represented in FIG. 2, measuring device 35 can be disposed in the transport path 31 at a distance $r_1+r_2$ in front of the cutting device. In this embodiment the feed path for separate receiving sheets must of course discharge before the measuring device 35 in the transport path 31. Thus, when the supply is switched from one roll to supply from another roll, the front part of the web of the first roll must first be withdrawn from the cutting location out of the common transport path between measuring device 35 and cutting device 32 in order to guarantee undisturbed feed from another roll.

When cutting device 32 is of a type which can cut an advancing web of material, the cut edge of the roll will stop somewhat past the cutting location. These material web starting positions differing from the cutting location can be taken into account by adjusting the timing of the operations to be controlled by control device 36.

For adjustment of margining device 43 it is also possible to use just the signals generated by measuring device 35, hence not only for determining the LED's of margining device 43 which are to be temporarily switched off, but also for determining the times at which these LED's have to be switched off and on again respectively.

Measuring device 35 may be in the form of a brush of electrically conductive material which extends across transport paths 31 and 34, respectively, and which during operation presses on an array of conductive electrical contacts which are insulated from one another, the material for measurement being passed between the contacts and the brush so that the contact between the brush and the array is locally interrupted and a signal is generated corresponding to the width and position of the material in the path. A measuring device of this kind is known per se from Xerox Disclosure Journal of March/April 1983, pages 163 to 164, and of November/December 1984, pages 395–396.

Measuring device 35 can also be formed by a row of sensors which can respond to a luminous flux which is interrupted by the material at the place where the same passes.

While presently preferred embodiments of the invention have been shown and described in particularity, the invention may be otherwise embodied within the scope of the appended claims.

We claim:

1. A method for automatically and selectively supplying material in web form of different widths from one of a plurality of storage locations in a common path, comprising:

(a) feeding a part of the stored material web into said common path;

(b) measuring the width of said part and generating a signal representative of the storage location from which said part originates;

(c) determining a data item representative of the measured width and the signalled storage location; and (d) removing from said common path the supplied part of the material web.

2. A method according to claim 1, wherein said removal is effected by withdrawing said material web from the common path.

3. A method according to claim 1, wherein the removal is effected by cutting off that part of the web material which is located in said common path and discharging the part so cut-off.

4. In apparatus comprising a holder for a plurality of rolls of web material of different widths, said holder having different locations into which said rolls can be inserted, transport means for selectively supplying web material from a roll located at holder location into a first common transport path, and a memory for storing data representative of the width and location of each roll in the holder and data inputting means for inputting said data into the memory, the improvement in combination therewith comprising a measuring device for measuring the width of the web material at a location situated in the first common transport path for providing a measurement signal representative of said measured width, and means for generating a second signal representative of the location of a roll from which the associated web material originates, said data inputting means in response to said measurement signal and the second signal automatically storing in said memory a data item representative of the width of the roll of web material at its location in said holder.

5. The improvement according to claim 4, including (a) a cutting device disposed in said common transport path in front of the measuring station for cutting an initial strip from a roll of web material inserted in said holder and (b) means for activating said data inputting means upon activation of the cutting device after insertion of said roll.

6. The improvement according to claim 5, including a deflecting element disposed after said cutting device for deflecting web material originating from a roll of said web material in said holder into a second common transport path and wherein said measuring station is positioned in said second transport path.

7. A copying machine for copying an original on receiving material, which copying machine is provided with adjustable margining means for limiting the area in which copying is carried out in a direction transversely of the feed direction of the receiving material, and having apparatus according to claim 4 in which said receiving material in web form can be fed from a selected roll and separate sheets of receiving material can be fed via said second transport path into said copying machine; margin adjusting means adapted to adjust said margining means in accordance with the data item stored in said memory as representative of the width of the selected roll of web material when the copying machine is set to copy on receiving material in web form; and which, when the copying machine is set to copying on separate sheets of receiving material, in response to an incoming sheet activate the measuring device and the margining means for automatically setting the margining means in accordance with the measured width of the sheet.

* * * * *